US006237858B1

(12) United States Patent
Lewis

(10) Patent No.: US 6,237,858 B1
(45) Date of Patent: May 29, 2001

(54) WATERFALL CLOCK

(76) Inventor: Devon L. Lewis, P.O. Box 8060, Melrose Park, IL (US) 60161

( * ) Notice: Subject to any disclaimer, the term of this patent is extended or adjusted under 35 U.S.C. 154(b) by 0 days.

(21) Appl. No.: 09/378,611

(22) Filed: Aug. 20, 1999

(51) Int. Cl.[7] ..... F21S 8/00
(52) U.S. Cl. ..... 239/18; 239/20; 446/267
(58) Field of Search ..... 239/16, 17, 18, 239/20, 22, 23; D23/201; 40/406, 407, 409, 312; 446/267 Y; 285/140.1, 196, 338, 205

(56) References Cited

U.S. PATENT DOCUMENTS

| | | | | |
|---|---|---|---|---|
| D. 9,353 | | 6/1876 | Fiske . | |
| 77,290 | | 4/1868 | Johnson . | |
| 267,689 | | 11/1882 | Hoax . | |
| 286,261 | | 10/1883 | Bush . | |
| 428,365 | | 5/1890 | Baillairge . | |
| 636,803 | | 11/1899 | Hollingsworth . | |
| 861,372 | | 7/1907 | Leekman . | |
| 1,073,521 | * | 9/1913 | Reichart | 239/18 |
| 1,939,803 | | 12/1933 | Cataldi . | |
| 2,594,887 | | 4/1952 | Crockett . | |
| 3,635,402 | | 1/1972 | Kawamura et al. . | |
| 3,702,172 | * | 11/1972 | Hawkins | 239/18 |
| 4,205,785 | | 6/1980 | Stanley . | |
| 5,234,728 | * | 8/1993 | Chiang | 428/13 |

* cited by examiner

*Primary Examiner*—Andres Kashnikow
*Assistant Examiner*—Lisa Ann Douglas
(74) *Attorney, Agent, or Firm*—Meroni & Meroni; Charles F. Meroni, Jr.

(57) ABSTRACT

A water fall clock comprising a basin, the basin defining a water well, a water fountain, the water fountain being supported by the basin, and a transparent cover. The transparent cover is positioned on the basin and encloses the water fountain. The transparent cover is sized and shaped to encase the water fountain. The water fountain has at least one water spout for ejecting water within the transparent cover. The water fountain further comprises a water pump, the water pump is positioned within the water well, a water pipe, the water pipe extends between the water pump and the water spout and allows water to pass from the water pump to the water spout. The water fountain allows fallen water from the water spout to flow into the water well for recirculation by the water pump. A clock can further be secured to the basin, thereby creating a decorative enclosed water fall clock structure. A cabinet structure can enclose the basin, thereby creating a decorative enclosed basin. A canopy can be further added on top of the transparent cover whereby a clock can be secured to the canopy.

21 Claims, 6 Drawing Sheets

WATERFALL CLOCK

BACKGROUND OF THE INVENTION

The present invention relates generally to a new type of fountain. More specifically the present invention provides an enclosed working fountain with or without a clock that provides a soothing water falling sound, wherein the enclosed fountain can be placed on an office desk or the like to provide a new and unique decorative display as well as a pleasant water falling sound.

There have been various types of water fountains available in the marketplace. Many people enjoy watching water fountains or being near water fountains to admire their beauty and to listen to the soothing sound of rushing water. Water fountains provide a pleasant decorative display, and can also be costly if one wishes to own and maintain one. These water fountains are typically designed to be fairly large and are placed outdoors, or can take up a large portion of space indoors. Furthermore, these types of water fountains can be difficult to move and cannot be typically enjoyed in smaller areas such as an office.

These and other types of water fountains used in the past do not offer the flexibility and inventive features of my water fountain structure. As will be described in greater detail hereinafter, the water fountain structure of the present invention differs from those previously proposed.

It is therefore an object of the present invention to provide a water fountain that is portable and can be enjoyed on a standard table top. It is a further object of the present invention to provide a water fountain that is easy to maintain, provides a decorative display, and can also provide a soothing water falling sound.

SUMMARY OF THE INVENTION

According to my present invention I have provided a water fall structure for adornment of a table top, the water fall structure comprising a basin, the basin supporting a water fountain, the water fountain being enclosed within a transparent cover, the transparent cover being sized and shaped to encase the water fountain, the water fountain having at least one water spout for ejecting water within the transparent cover, thereby creating a decorative enclosed water fall structure.

I have further provided a water fall structure as described above, further including a clock, the clock being secured to the basin, thereby creating a decorative enclosed water fountain with a clock.

Still another feature of my invention concerns the water fall structure as described above, wherein the water fountain includes a water pump, the water pump acting to eject water from the water spout.

Still yet another feature of my invention concerns the water fall structure as described above, wherein the water fountain includes a decorative figurine and a water pipe, the water pipe extending through the decorative figurine to the water spout.

Yet another feature of my invention concerns the water fall structure as described above, wherein the decorative figurine is supported by a lower base.

A still further feature of my invention concerns the water fall structure as described above, wherein the water pump is positioned within the basin below the decorative figurine, the water pump further being hidden from view by the lower base of the decorative figurine.

An even further feature of my invention concerns the water fall structure as described above, wherein a connection between the decorative figurine and the water pump is a water-tight seal.

Yet still another feature of my invention concerns the water fall structure as described above, wherein the water-tight seal is comprised of a rubber stopper having an axially extending hole to enable water to pass through the rubber stopper.

According to other features in invention I have provided a water fall structure as described above, wherein the transparent cover includes at least one opening to enable a sound of falling water to emanate from the water fall structure.

Still another feature of my invention concerns the water fall structure as described above, further including a light source, the light source being positioned on the water fall structure so as to illuminate the water fountain.

Yet another feature of my invention concerns a water fall structure for adornment of a table top, the water fall structure comprising a basin, the basin defining a water well, a water fountain, the water fountain being supported by the basin, and a transparent cover, the transparent cover being positioned on the basin and enclosing the water fountain, the transparent cover being sized and shaped to encase the water fountain, the water fountain comprising a water pump, the water pump being positioned within the water well, a figurine base, the figurine base being positioned above the water well, a figurine, the figurine being positioned above the figurine base and having at least one water spout for ejecting water within the transparent cover, the figurine base further acting to support the figurine, a water pipe, the water pipe extending through the figurine to the water spout, the water pipe being connected to the water pump through the figurine base by a water-tight seal and allowing water to pass from the water pump to the water spout, the figurine base having axially extending water passages allowing fallen water from the water spout to flow into the water well for recirculation by the water pump, thereby creating a decorative enclosed water fall structure.

A further feature of my invention concerns the water fall structure as described above, wherein the axially extending water passages are circumferentially spaced about the figurine base.

A water fall structure for adornment of a room floor, said water fall clock having a base, the base including a basin, a water fountain supported on the base, a transparent cover supported on said base, said transparent cover being sized and shaped to partially encapsulate said water fountain, a canopy, said water fountain having at least one water spout for ejecting water within the transparent cover, thereby creating a decorative enclosed water fall structure.

I have further provided a water fall structure as described above, further including a clock, said clock being secured to the canopy, thereby creating a decorative enclosed water fountain with a clock.

Still another feature of my invention concerns the water fall structure as described above, wherein the water fountain includes a water pump, said water pump acting to eject water from the water spout, said water pump being positioned within the basin below a decorative figurine, said water pump further being hidden from view by a lower base of said decorative figurine.

Still yet another feature of my invention concerns the water fall structure as described above wherein said water fountain includes a decorative figurine and a water pipe, said water pipe extending through the decorative figurine to the water spout, said decorative figurine is supported on said figurine base.

Yet another feature of my invention concerns the water fall structure as described above wherein a connection between said decorative figurine and the water pump is a water-tight seal, said water-tight seal is comprised of a rubber stopper having an axially extending hole to enable water to pass through the rubber stopper.

Yet another feature of my invention concerns the water fall structure as described above includes a transparent cover frame, said transparent cover frame framing said transparent cover, said transparent cover comprises a plurality of glass panels circumferentially spaced about said basin.

Still yet another feature of my invention concerns the water fall structure described above wherein said transport cover frame supports said canopy.

According to other features in the invention I have provided a water fall structure as described above wherein said transparent cover includes at least one opening to enable a sound of falling water to emanate from the water fall structure, and a light source, said light source being positioned on said water fall structure so as to illuminate said water fountain.

A further feature of my invention concerns the water fall structure as described above, wherein the axially extending water passages are circumferentially spaced about the figurine base.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
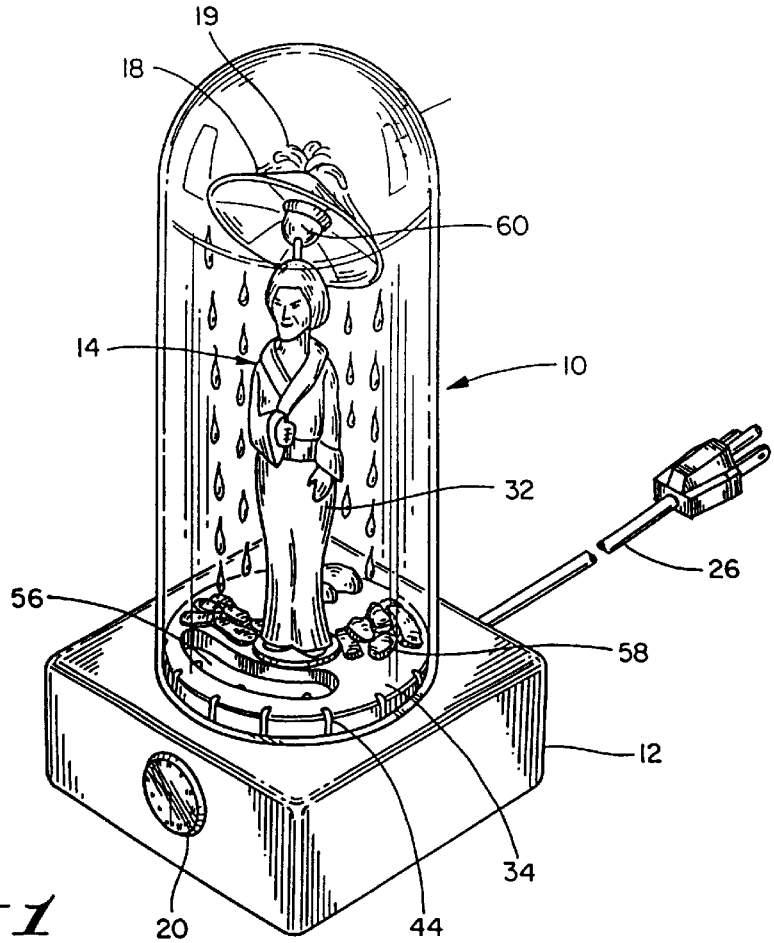
FIG. 1 is a perspective view of my water fall clock illustrating the preferred embodiment features of my invention.
Figure 2:
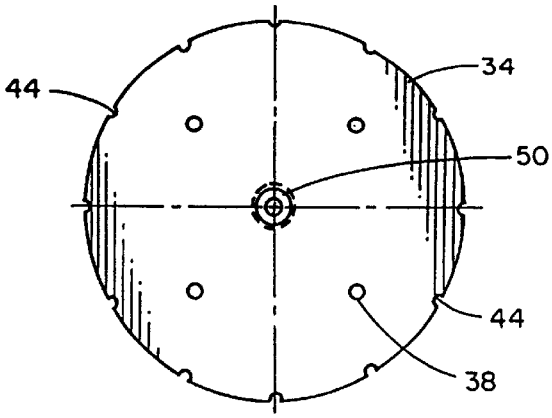
FIG. 2 is a bottom side view of the base used within my water fall clock.
Figure 3:
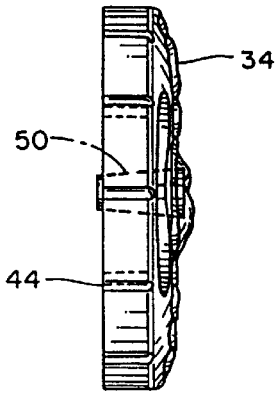
FIG. 3 is a side view of the base use within my water fall clock illustrating further features of my invention.
Figure 4:
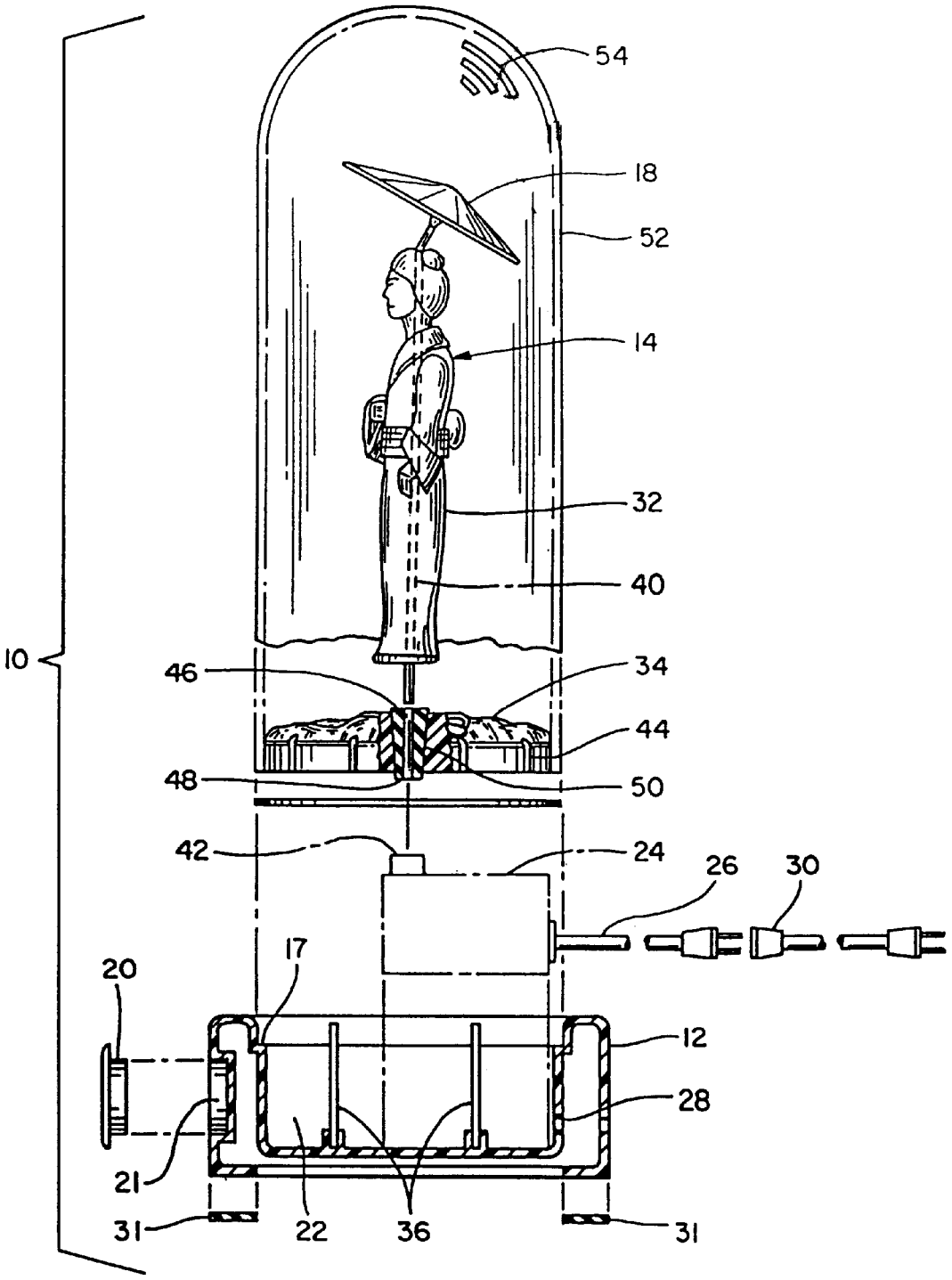
FIG. 4 is an exploded, partial cross-sectional side view of my water fall clock illustrating the way in which my water fall clock is assembled.

Referring now to the drawings, FIGS. 1 and 4 show my water fall structure 10 for my preferred embodiment. My water fall structure comprises a basin 12, a water fountain 14, and a transparent cover 16. The basin 12 acts to help support the water fountain 14 and the transparent cover 16. The basin 12 can be comprised of various different materials including marble, glass, wood, or plastic. The transparent cover 16 is sized and shaped to encase the water fountain 14 and is sized to sit upon an upper edge 17 (FIG. 4) of the basin 12. The transparent cover 16 can be either a typical glass or plastic type dome. The water fountain has at least one water spout 18 for ejecting water 19 within the transparent cover 16. My water fall structure 10 can also include a clock 20 that can be affixed to the basin 12. Various different types of clocks sized to fit on the water fall structure 10 can be used. It is intended that the clock is of a design that conforms with the design of the water fall structure. In the present design, the basin 12 has a small well 21 designed to help hold the clock 20 in place.

Figure 5:
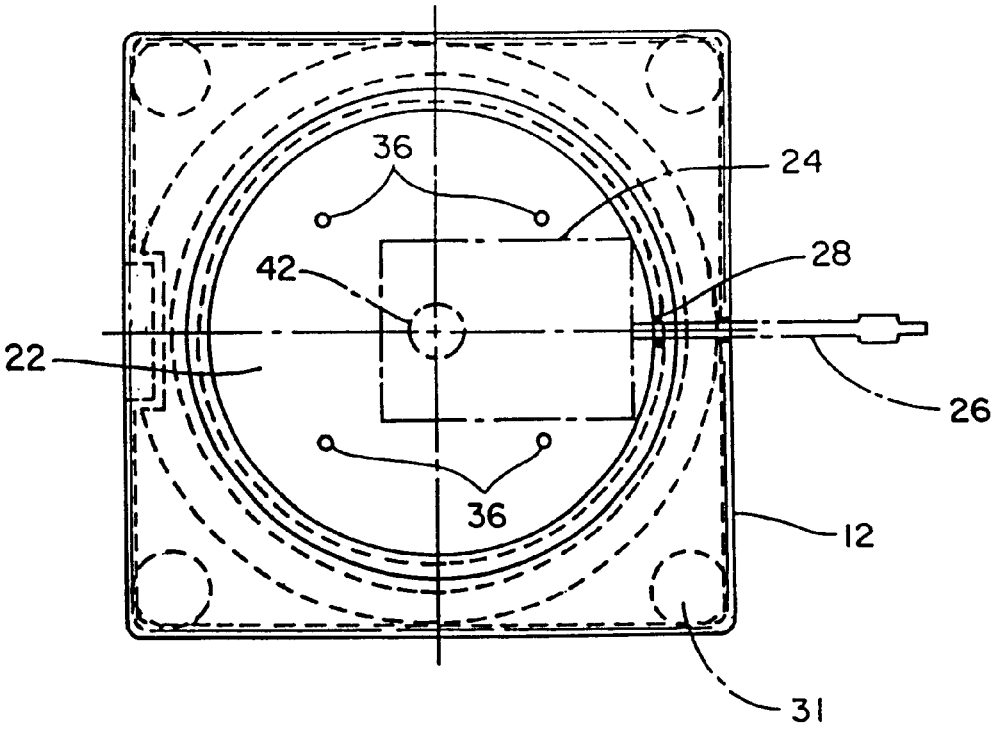
FIG. 5 is a top side view of the basin illustrating the position of the pump used with my water fall clock.
Figure 6:
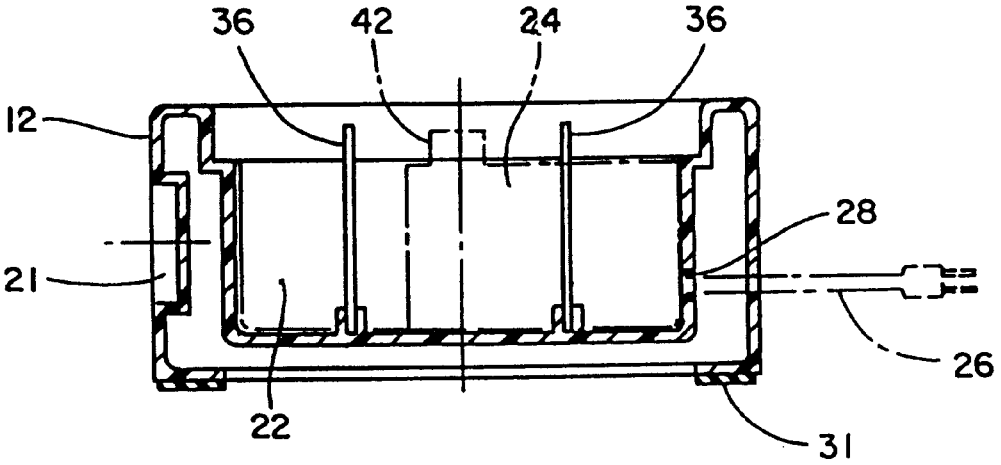
FIG. 6 is a cross-sectional side view of the basin used with my water fall clock further illustrating the position of my pump within the basin.

In order to hold the water for use with the water fountain, the basin 12 is shaped to include a water well 22 (FIGS. 4, 5, 6). Within the water well 22 a water pump 24 is positioned. The water pump is used to eject water from the water fountain and to recirculate the water within the water fountain. The water pump can be powered by an electrical cord 26 extending through a water-tight fitting 28 positioned against a back wall on the basin 12. It is preferable that the electrical cord 26 is a short cord that requires an attachment to an extension cord 30, therefore the electrical cord 26 would not get in the way while the water fall structure 10 is moved to another location. The basin can further include scratch-resistant pads 31 positioned along the bottom four corners to prohibit scratching an abutting surface.

The water fountain 14 can be comprised of a figurine 32 positioned above a figurine base 34 (FIGS. 1–4). The figurine base 34 also acts to provide a support for the figurine 32 to help keep the figurine 32 securely in place. The figurine 32 and figurine base 34 can be composed of various different types of materials including clay, plastic, metal, or wood. Any materials that can rust or decay due to water exposure should be adequately water-proofed and rust-proofed. The figurine base 34 is sized to fit along a top portion of the basin 12 above the water well 22. The figurine base 34 can be stabilized on the basin 12 many different ways. One method is to provide stabilizing prongs 36 that extend from the base of the water well 22 into pre-aligned holes 38 on the bottom side of the figurine base 34. Excellent results can be obtained when the water spout 18 for ejecting water within the transparent cover 16 is positioned atop the figurine 32.

The figurine base 34 can be further designed to have axially extending water passages 44 extending along the width of the figurine base to allow water that has fallen from the water spout 18 to flow into the water well 22. The water can then be recirculated by the water pump 24. To help make the figurine base 34 more decorative, the water passages 44 are circumferentially spaced about the figurine base. To further increase the decorative appearance, the water pump 24 is positioned within the water well 22 below the figurine base 34, and is hidden from view.

To be able to transport water to the water spout 18, I have provided a water pipe 40 that extends through the figurine 32 to the water spout 18. The water pipe 40 is connected to a water discharge port 42 on the water pump 24. The connection of the water pipe 40 to the discharge port 42 should be water-tight. One way to create a watertight seal is to use a rubber stopper 46 having an axially extending hole 48. The hole 48 in the rubber stopper can tightly secure a lower portion of the water pipe 40 and can be plugged into the water pump discharge port 42 to create a water-tight seal. The rubber stopper is sized to fit through a hole 50 positioned through the figurine base 34. This water-tight seal created by the rubber stopper allows water to pass from the water pump through the water pipe and eject from the water spout.

Figure 9:
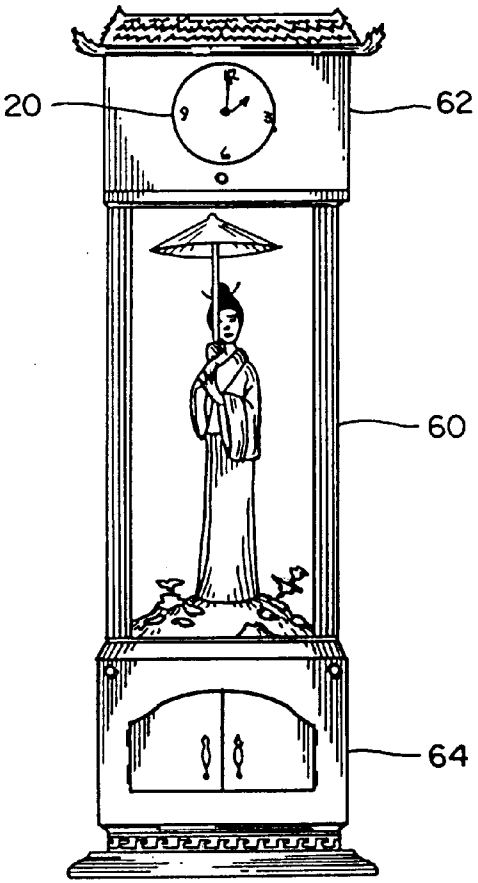
FIG. 9 is a perspective view of my water fall clock illustrating the alternative embodiment features of my invention.
Figure 8:
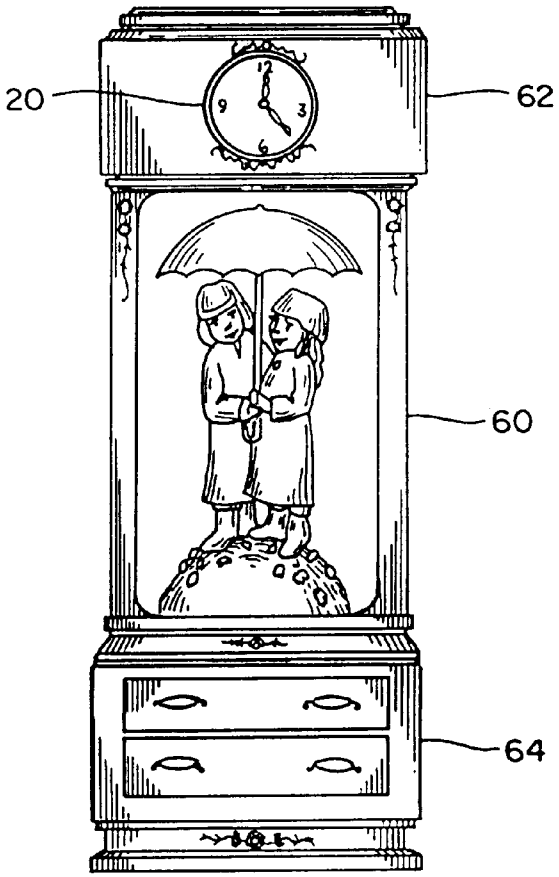
FIG. 8 is a perspective view of my water fall clock illustrating the alternative embodiment features of my invention.
Figure 7:
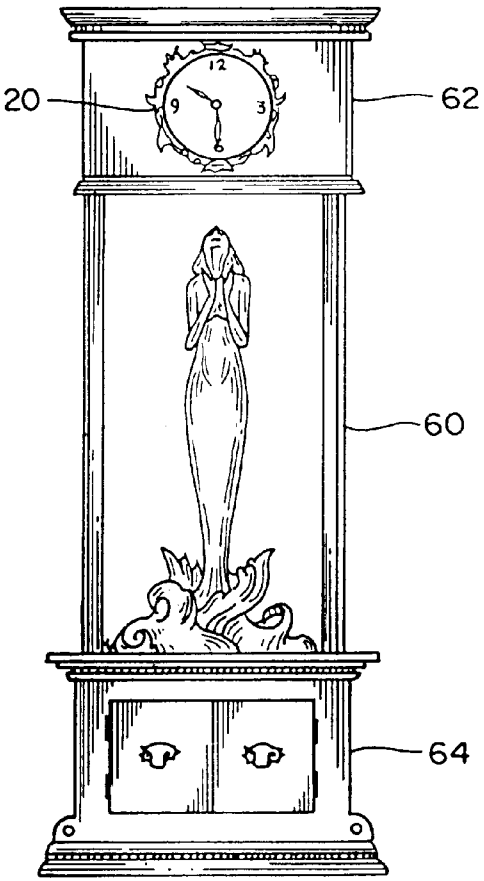
FIG. 7 is a perspective view of my water fall clock illustrating the alternative embodiment features of my invention.
Figure 10:
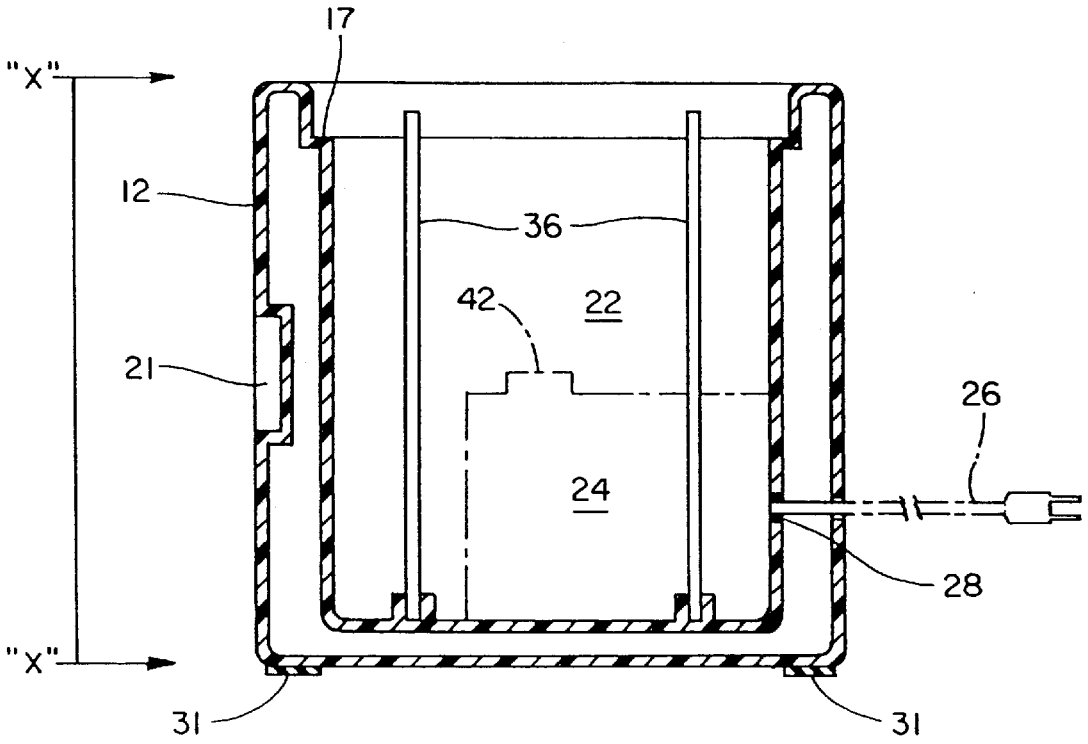
FIG. 10 is a side view along line X—X of the basin used with my water fall clock in the alternative embodiment.
Figure 11:
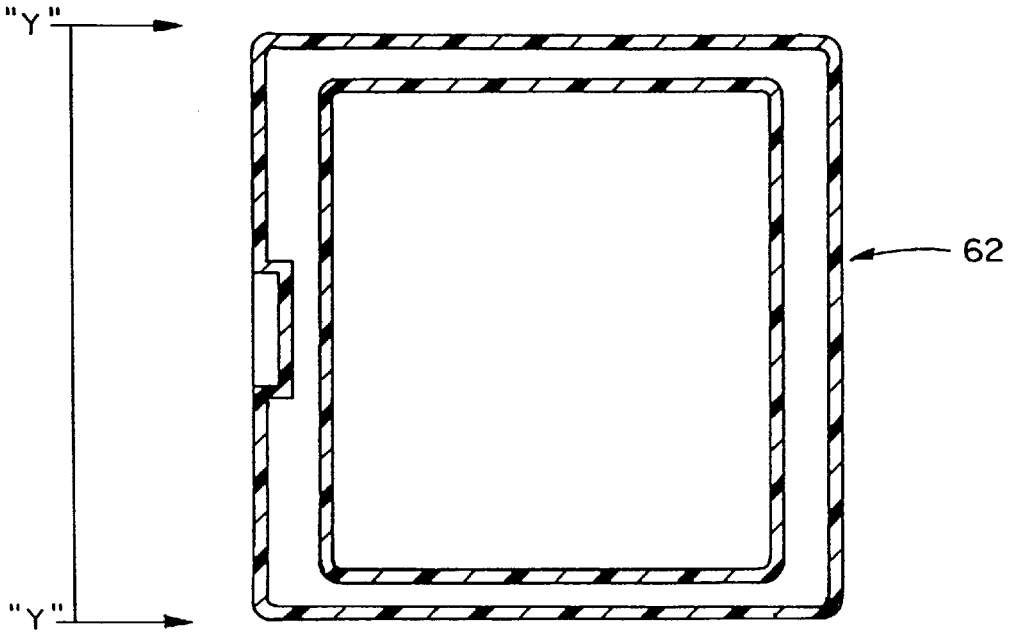
FIG. 11 is a side view along line Y—Y of the clock enclosure used with my water fall clock illustrating the canopy.
Figure 12:
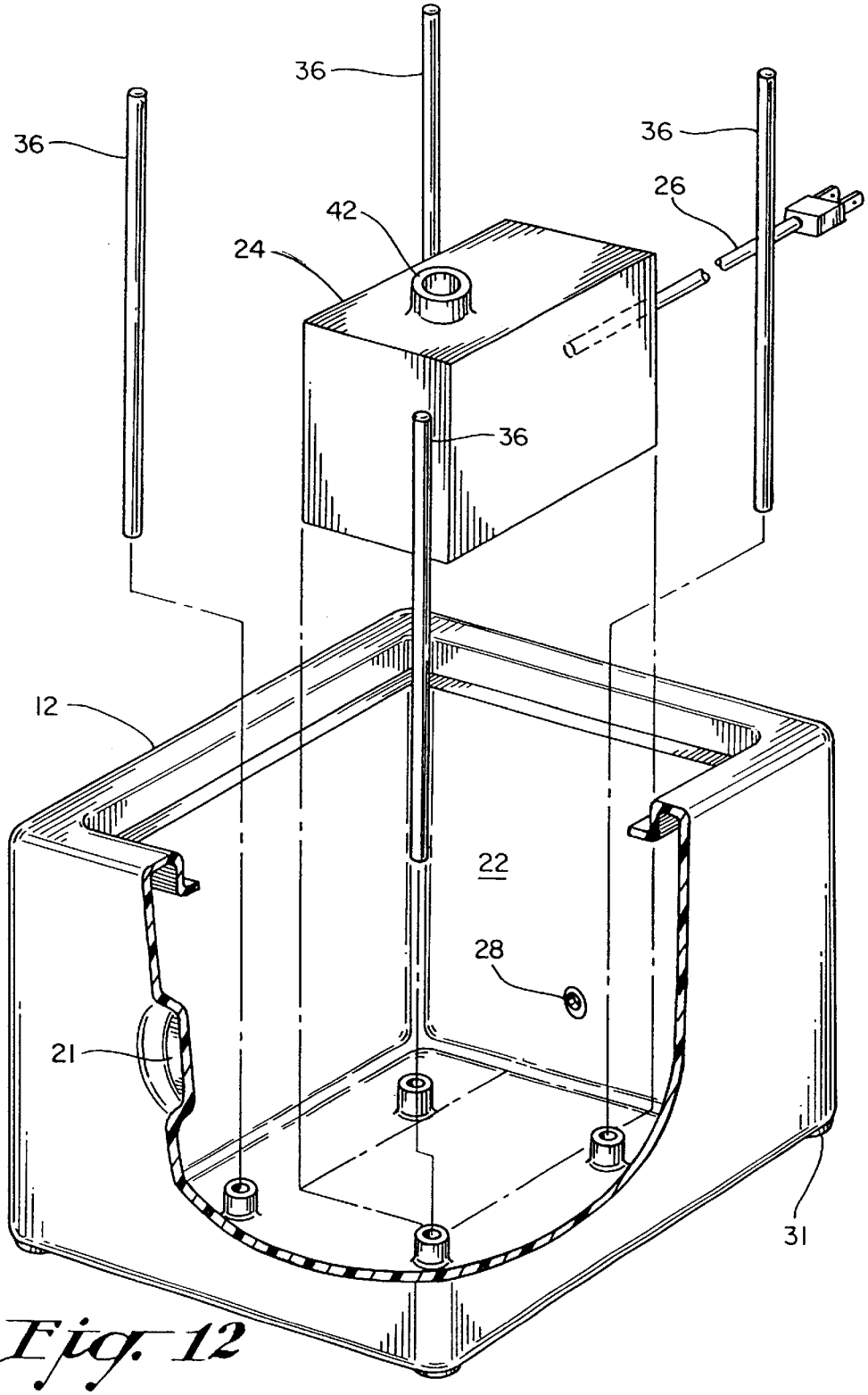
FIG. 12 is an exploded view of the basin used with my water fall clock.

In an alternative embodiment, the water fall structure 10 can also be used for a room floor and provides a base 64 to enclose the basin 12. The base 64 can be comprised of various different materials including marble, glass, wood or plastic. The base 64 can be designed with numerous types of constructions with various types of configurations. The water fall structure 10 can also provide a transparent cover frame 60 (FIGS. 7,8, & 9). Additionally, in order to accommodate the numerous different types of figurines 32, the transparent cover frame 60 frames the transparent cover 16. The transparent cover frame 60 can be comprised of various different materials including marble, glass, wood or plastic. Additionally, the transparent cover frame 60 can be designed with numerous types of constructions with various types of configurations.

In the alternative embodiment, the water fall structure 10 can also provide canopy 62 located on top of the transparent cover 16 (FIGS. 7,8 & 9). In order to support the canopy 62, the transparent cover frame 60 connects the basin 12 to the canopy 62. My water fall structure 10 can also include a clock 20 that can be affixed to the canopy 62. Various types of clocks sized to fit in the water fall structure 10 can be used. It is intended that the clock 20 is of a design that conforms with the design of the water fall structure. The canopy 62 can be comprised of various different materials including marble, glass, wood or plastic. The canopy 62 can be designed with numerous types of constructions with various types of configurations.

The water fall structure 10 of the present invention can also provide a soothing water falling sound from the fountain. In order to enhance the sound of the falling water, FIG. 4 illustrates my water fall structure with a slightly different transparent cover 52, wherein the transparent cover 52 has slotted openings 54 on the upper portion of the transparent cover to enable the sound of the falling water to emanate louder from the water fall structure. The openings 54 can be positioned in various locations, however, the openings should be positioned or covered in such a way so as to prohibit water from exiting the openings.

Another type of decorative feature that can also be included with the water fall structure is the inclusion of a light source. The light source can be either electrically powered lights or glowing luminescent light. The light source should be positioned so as to increase the decorative viewing effect of the water fall structure. In the particular embodiment shown in FIG. 1, the light source can come from various portions on the water fountain, including: the pond 56, the rocks 58, and the underside of the umbrella 60.

It is my intention that the word transparent cover embraces not only lid type coverings but also a grouping of a plurality of glass panels circumferntially spaced about the basin.

The figurine 32 illustrated in the accompanying drawings is. to provide an idea as to the basis of the present invention, it is contemplated that the water fountain can be designed with numerous different types of figurines having various different types of configurations. As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A water fall structure for adornment of a table top, said water fall structure comprising a basin, said basin defining a water well, a water fountain, said water fountain being supported by said basin, and a transparent cover, said transparent cover being positioned on the basin and enclosing said water fountain, said transparent cover being sized and shaped to encase said water fountain, said water fountain comprising a water pump, said water pump being positioned within said water well, a figurine base, said figurine base being positioned above said water well, a figurine, said figurine being positioned above said figurine base and having at least one water spout for ejecting water within the transparent cover, said figurine base further acting to support said figurine, a water pipe, said water pipe extending through the figurine to the water spout, said water pipe being connected to the water pump through the figurine base by a water-tight seal and allowing water to pass from the water pump to the water spout, said figurine base having axially extending water passages allowing fallen water from the water spout to flow into said water well for recirculation by said water pump, thereby creating a decorative enclosed water fall structure.

2. The water fall structure of claim 1, further including a clock, said clock being secured to the basin, thereby creating a decorative enclosed water fountain with a clock.

3. The water fall structure of claim 1, wherein said water-tight seal is comprised of a rubber stopper having an axially extending hole to enable water to pass through the rubber stopper.

4. The water fall structure of claim 1, wherein said transparent cover includes at least one opening to enable a sound of falling water to emanate from the water fall structure.

5. The water fall structure of claim 1, further including a light source, said light source being positioned on said water fall structure so as to illuminate said water fountain.

6. The water fall structure of claim 1, wherein the axially extending water passages are circumferentially spaced about the figurine base.

7. In combination, a waterfall structure and a clock, said waterfall structure comprising a basin, said basin defining a water well, a water fountain, said water fountain being supported by said basin, and a transparent cover, said transparent cover being positioned on the basin and enclosing said water fountain, said transparent cover being sized and shaped to encase said water fountain, said water fountain having at least one water spout for ejecting water within the transparent cover, said water fountain further comprises a water pump, said water pump being positioned within said water well, a water pipe, said water pipe extending between said water pump and said water spout and allowing water to pass from the water pump to the water spout, said water fountain allowing fallen water from the water spout to flow into said water well for recirculation by said water pump, said clock being secured to said basin, thereby creating a decorative enclosed waterfall structure, said figurine base having axially extending water passages allowing fallen water from the water spout to flow into said water well for recirculation by said water pump.

8. A waterfall structure for adornment of a table top, said waterfall structure comprising a basin, said basin supporting a water fountain, said water fountain being enclosed within a transparent cover, said transparent cover being sized and shaped to encase said water fountain, said water fountain having at least one water spout for ejecting water within the transparent cover, thereby creating a decorative enclosed waterfall structure, said transparent cover includes at least one opening to enable a sound of falling water to emanate from the waterfall structure.

9. The water fall structure of claim 8, further including a light source, said light source being positioned on said water fall structure so as to illuminate said water fountain.

10. A waterfall structure for adornment of a table top, said waterfall structure comprising a basin, said basin supporting a water fountain, said water fountain being enclosed within a transparent cover, said transparent cover being sized and shaped to encase said water fountain, said water fountain having at least one water spout for ejecting water within the transparent cover, thereby creating a decorative enclosed waterfall structure, said water fountain includes a decorative figurine and a water pipe, said transparent cover having an open end and with said decorative figurine extending through the open end thus encasing the decorative figurine therein, said water pipe extending through the decorative figurine to at least one water spout, said decorative figurine is supported on a lower base, said water fountain includes a water pump, said water pump acting to eject water from the water spout, said water pump being positioned within the basin below said decorative figurine, said water pump further being hidden from view by the lower base of said decorative figurine, a connection between said decorative figurine and the water pump is a water-tight seal, said water-tight seal includes a rubber stopper having an axially extending hole, a lower end of said water pipe being coaxially aligned with said hole in the rubber stopper and being embedded in the rubber stopper in watertight engagement therewith and enabling water to pass through the rubber stopper to said water pump for recirculation, the decorative figurine being seated on top of said rubber stopper and with said water pipe extending through said decorative figurine as well as through said rubber stopper.

11. In combination, a waterfall structure and a clock, said waterfall structure comprising a basin, said basin defining a water well, a water fountain, said water fountain being supported by said basin, and a transparent cover, said transparent cover being positioned on the basin and enclosing said water fountain, said transparent cover being sized and shaped to encase said water fountain, said water fountain having at least one water spout for ejecting water within the transparent cover, said water fountain further comprises a water pump, said water pump being positioned within said water well, a water pipe, said water pipe extending between said water pump and said water spout and allowing water to pass from the water pump to the water spout, said water fountain allowing fallen water from the water spout to flow into said water well for recirculation by said water pump, said clock being secured to said basin, thereby creating a decorative enclosed waterfall structure and a clock, said water fountain further comprises a figurine base, said figurine base being positioned above said water well, a figurine, said figurine being positioned above said figurine base, said figurine base further acting to support said figurine, said water spout being positioned on said figurine, said water pipe being connected to the water pump through the figurine base by a water-tight seal and allowing water to pass from the water pump to the water spout, said figurine base having axially extending water passages allowing fallen water from the water spout to flow into said water well for recirculation by said water pump.

12. In combination, a waterfall structure and a clock, said waterfall structure comprising a basin, said basin defining a water well, a water fountain, said water fountain being supported by said basin, and a transparent cover, said transparent cover being positioned on the basin and enclosing said water fountain, said transparent cover being sized and shaped to encase said water fountain, said water fountain having at least one water spout for ejecting water within the transparent cover, said water fountain further comprises a water pump, said water pump being positioned within said water well, a water pipe, said water pipe extending between said water pump and said water spout and allowing water to pass from the water pump to the water spout, said water fountain allowing fallen water from the water spout to flow into said water well for recirculation by said water pump, said clock being secured to said basin, thereby creating a decorative enclosed waterfall structure and a clock, said transparent cover includes at least one opening to enable a sound of falling water to emanate from the waterfall structure.

13. A waterfall structure for adornment of a table top, said waterfall structure having a base, the base including a basin, a water fountain supported on the base, a transparent cover supported on said base, said transparent cover being sized and shaped to completely encapsulate said water fountain, said water fountain having at least one water spout for ejecting water within the transparent cover, thereby creating a decorative enclosed waterfall structure, said transparent cover includes at least one opening to enable a sound of falling water to emanate from the waterfall structure.

14. A waterfall structure for adornment of a room floor, said waterfall structure having a base, the base including a basin, a water fountain supported on the base, a transparent cover supported on said base, said transparent cover being sized and shaped to partially encapsulate said water fountain, a canopy, said water fountain having at least one water spout for ejecting water within the transparent cover, thereby creating a decorative enclosed waterfall structure, a clock, said clock being secured to the canopy, thereby creating a decorative enclosed water fountain with a clock.

15. The waterfall structure of claim 14, wherein said water fountain further comprises a figurine base, said figurine base being positioned above said water well, a figurine, said figurine being positioned above said figurine base, said figurine base further acting to support said figurine, said water spout being positioned on said figurine, said water pipe being connected to the water pump through the figurine base by a water-tight seal and allowing water to pass from the water pump to the water spout, said figurine base having axially extending water passages allowing fallen water from the water spout to flow into said water well for recirculation by said water pump.

16. The waterfall structure of claim 14, wherein said transparent cover includes at least one opening to enable a sound of falling water to emanate from the water fall structure.

17. A waterfall structure for adornment of a room floor, said waterfall structure having a base, the base including a basin, a water fountain supported on the base, a transparent cover supported on said base, said transparent cover being sized and shaped to partially encapsulate said water fountain, a canopy, said water fountain having at least one water spout for ejecting water within the transparent cover, thereby creating a decorative enclosed waterfall structure, said waterfall structure includes a transparent cover frame, said transparent cover frame framing said transparent cover, said transparent cover comprising a plurality of glass panels circumferentially spaced about said basin.

18. The water fall structure of claim 17, wherein said transparent cover frame supports said canopy.

19. The water fall structure of claim 17, wherein said transparent cover includes at least one opening to enable a sound of falling water to emanate from the water fall structure.

20. A waterfall structure for adornment of a room floor, said waterfall structure having a base, the base including a basin, a water fountain supported on the base, a transparent cover supported on said base, said transparent cover being sized and shaped to partially encapsulate said water fountain, a canopy, said water fountain having at least one water spout for ejecting water within the transparent cover, thereby creating a decorative enclosed waterfall structure, said transparent cover includes at least one opening to enable a sound of falling water to emanate from the waterfall structure.

21. The water fall structure of claim 10, wherein said transparent cover includes at least one opening to enable a sound of falling water to emanate from the water fall structure.

* * * * *